US010151044B2

(12) United States Patent
Burchardt et al.

(10) Patent No.: US 10,151,044 B2
(45) Date of Patent: Dec. 11, 2018

(54) REMOVABLE ANODISING AGENT, IN PARTICULAR FOR LOCAL ANODIC OXIDATION OF METAL SURFACES

(75) Inventors: Malte Burchardt, Bremen (DE); Stefan Dieckhoff, Lilienthal (DE); Andreas Hartwig, Ritterhude (DE); Malte Kleemeier, Bremen (DE); Katharina Teczyk, Bremen (DE); Philippe Vulliet, Annecy (FR); Armin Fangmeier, Rahden (DE)

(73) Assignees: FRAUNHOFER-GESELLSCHAFT ZUR FÖRDERUNG DER ANGEWANDTEN FORSCHUNG E.V., München (DE); AIRBUS OPERATIONS GMBH, Hamberg (DE)

( * ) Notice: Subject to any disclaimer, the term of this patent is extended or adjusted under 35 U.S.C. 154(b) by 836 days.

(21) Appl. No.: 14/006,353

(22) PCT Filed: Mar. 22, 2012

(86) PCT No.: PCT/EP2012/055044
§ 371 (c)(1),
(2), (4) Date: Nov. 14, 2013

(87) PCT Pub. No.: WO2012/126969
PCT Pub. Date: Sep. 27, 2012

(65) Prior Publication Data

US 2014/0061055 A1 Mar. 6, 2014

(30) Foreign Application Priority Data

Mar. 22, 2011 (DE) ..... 10 2011 005 918

(51) Int. Cl.
*C25D 11/06* (2006.01)
*C25D 11/10* (2006.01)
(Continued)

(52) U.S. Cl.
CPC ..... *C25D 17/12* (2013.01); *C25D 11/005* (2013.01); *C25D 11/022* (2013.01); *C25D 11/06* (2013.01);
(Continued)

(58) Field of Classification Search
CPC ..... C25D 11/022; C25D 11/02–11/34
See application file for complete search history.

(56) References Cited

U.S. PATENT DOCUMENTS 3,616,311 A * 10/1971 Barkman ..... C25D 11/14 205/330
5,160,590 A 11/1992 Totsuka et al.
(Continued)

FOREIGN PATENT DOCUMENTS

DE 1204046 10/1965
EP 0880310 A1 * 11/1998 ..... C25D 11/10
(Continued)

OTHER PUBLICATIONS

Written Opinion of the International Searching Authority for PCT/EP2012/055044 (dated 2012).*
(Continued)

*Primary Examiner* — Bryan D. Ripa
*Assistant Examiner* — Ho-Sung Chung
(74) *Attorney, Agent, or Firm* — Preti Flaherty Beliveau & Pachios LLP

(57) ABSTRACT

The invention relates to a removable anodizing agent, in particular for local anodic oxidation of metal surfaces, and its use, and a method for anodic oxidation by means of an anodizing agent according to the invention.

14 Claims, 2 Drawing Sheets

Figure 1:
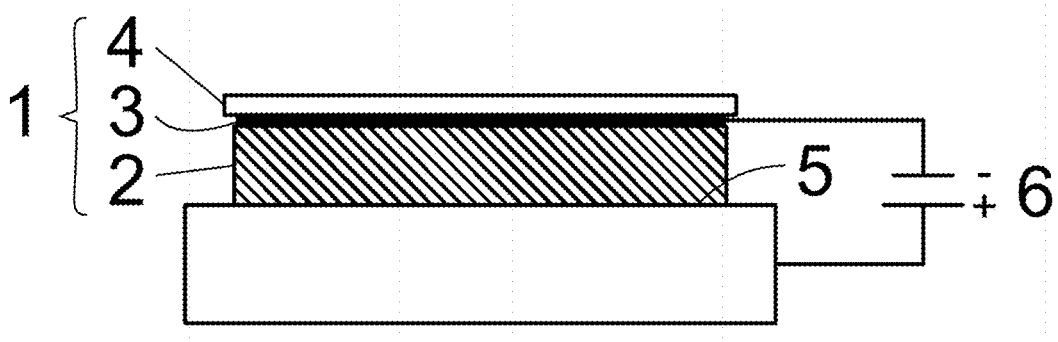

(51) Int. Cl.

| | |
|---|---|
| ***C25D 11/04*** | (2006.01) |
| ***C25D 17/12*** | (2006.01) |
| ***C25D 11/00*** | (2006.01) |
| ***C25D 11/02*** | (2006.01) |
| *C25D 11/26* | (2006.01) |
| *C25D 11/30* | (2006.01) |
| *C25D 11/34* | (2006.01) |

(52) U.S. Cl.
CPC ..... *C25D 11/04* (2013.01); *C25D 11/10* (2013.01); *C25D 11/26* (2013.01); *C25D 11/30* (2013.01); *C25D 11/34* (2013.01)

(56) References Cited

U.S. PATENT DOCUMENTS

| | | | | |
|---|---|---|---|---|
| 6,503,691 | B1 * | 1/2003 | Goodin | B41C 1/1041 430/271.1 |
| 2003/0152610 | A1 * | 8/2003 | Rolf | A61K 8/0208 424/449 |
| 2005/0126926 | A1 * | 6/2005 | Ogihara | C25F 5/00 205/674 |
| 2010/0021776 | A1 * | 1/2010 | Dougherty | C25D 9/08 429/406 |
| 2010/0067174 | A1 * | 3/2010 | Ning | H01G 9/048 361/516 |

FOREIGN PATENT DOCUMENTS

| | | |
|---|---|---|
| FR | 1585169 | 1/1970 |
| JP | 02073998 | 3/1990 |
| JP | 2008-070094 | 3/2008 |
| JP | 2008-070096 | 3/2008 |
| JP | 2008-073998 | 4/2008 |
| JP | 2008-093100 | 4/2008 |
| JP | 2009-070982 | 4/2009 |

OTHER PUBLICATIONS

Western Electric Co., Inc., Translation, FR U.S. Pat. No. 1,585,169 A (1969).*
Boutin et al., Machine Translation, EP 0 880 310. (Year: 1998).*

* cited by examiner

REMOVABLE ANODISING AGENT, IN PARTICULAR FOR LOCAL ANODIC OXIDATION OF METAL SURFACES

The invention relates to a removable anodising agent, in particular for local anodic oxidation of metal surfaces, and its use, and a method for anodic oxidation by means of an anodising agent according to the invention.

Anodisation (anodic oxidation) is a process commonly used in engineering for the processing of metal surfaces, e.g. aluminium and aluminium alloys. Anodisation is an electrochemical process by which a porous oxide layer securely bonded to the surface of a metal, for example aluminium, is created, which forms a suitable substrate for highly stressed paint finishes or adhesive bonds. Because the paint or adhesive applied penetrates into the porous oxide layer formed by the previous anodisation, high bonding strengths of the paint or adhesive can be achieved. In addition, the layer formed by the anodisation serves to protect the underlying metal from corrosive attack. In this way a corrosion creep of the paint or adhesive layers can be avoided and the long-term stability can be increased even under unfavourable conditions (effect of moisture, salts or acids).

Anodisation typically takes place by means of bath processing. To that end the metal parts to be anodised are hung into a bath containing an acidic solution (sulphuric, phosphoric, tartaric or oxalic acids are for example known) and anodically oxidised through the application of a direct voltage of between 5 and 50 V. A rinsing step then follows in which residues of the anodisation bath are washed from the surface.

Local anodisation in a limited area of a large, sometimes complex-shaped structure can only be performed in this way with a great deal of effort (e.g. by covering areas that are not to be anodised) and requires unnecessarily large bath volumes.

The possibility of performing local anodisation is above all desirable for the purposes of repair if a defective adhesive bond or painting of an existing object has to be renewed and high demands are set for the quality of the surface pretreatment. Having anodisation baths constantly available in a repair workshop is only economical in exceptional circumstances and the safe handling of the corrosive bath contents calls for well-trained staff. On the other hand, anodisation baths are not readily transportable, so that the anodisation of a metal surface at the site of an existing object using a bath process is generally not an option.

In the prior art a number of methods for local anodic oxidation of metal surfaces are known. One of these methods is tampon anodisation. With this method a fleece through which a liquid ion conductor (electrolyte) passes is arranged between the surface to be anodically oxidised and the cathode. This method and the associated equipment are relatively impractical due to the handling of the liquid electrolyte. The equipment needed to perform the anodisation is relatively high in volume and heavy and must also be retained during the anodisation. The treatment of larger areas requires a sequential method of working, in which the anodisation tool is slowly passed over the surface to be treated thus taking a relatively long time.

A further method known in the prior art for local anodic oxidation of metal surfaces is the PANTA method (phosphoric acid non-tank anodising), in which the surface to be anodically oxidised is coated with a phosphoric acid gel (obtained by thickening an aqueous phosphoric acid solution with fumed silica). The phosphoric acid gel is fixed using a porous structure, typically a woven fabric, preferably a plurality of layers of woven fabric, to the surface to be oxidised, wherein the woven fabric is saturated with the phosphoric acid gel. On the uppermost woven fabric layer a steel network is positioned as the cathode. Because of the need to secure a gel-like ion conducting medium to the surface to be anodically oxidised this method can only be used on surfaces that are arranged approximately horizontally and facing upwards, so not for example on the underside of a fuselage or a wing. In addition precautions must be taken prior to fixing of the gel, and once anodisation is complete the gel residues must be wiped and rinsed from the surface.

For further information on the PANTA method reference is made to the technical manual NAVAIR 01-1A-1 (TECHNICAL MANUAL, ENGINEERING HANDBOOK SERIES FOR AIRCRAFT, REPAIR, GENERAL MANUAL FOR STRUCTURAL REPAIR, Published under authority of the Secretary of the Air Force 15 Nov. 2006).

U.S. Pat. No. 5,160,590 A discloses a method for electrolytic processing of a metal surface wherein a paste containing an electrolyte is placed between the metal surface and counter electrode.

JP 02 170 982 A relates to an electrolyte paste for surface processing, wherein through the addition of an organic thickener and/or an inorganic thinner to an electrolyte solution a viscosity level of between 100 and 2000000 cps is adjusted.

JP 02 093 100 A relates to a method and a device for continuous electrolytic processing of a metal surface, wherein an electrolyte paste is used.

JP 02 073 998 A relates to an electrode device for electrolytic processing of a curved metal surface, wherein the device comprises an elastic body impregnated with electrolyte on an electrode.

JP 02 070 094 A and JP 02 070 096 A each relate to a method and a device for continuous electrolytic processing of a metal surface, wherein the metal surface is provided with a pattern.

DE 12 04 046 B discloses a method for anodic oxidation of parts of a thin layer of refractory metal, in particular for forming passive components of tantalum, wherein on the refractory metal layer a template is applied with insulation on the contact side, and which on the forming side has recesses into which a highly viscous electrolyte is introduced.

The problem for the present invention was to provide an anodising agent suitable for local anodic oxidation of a surface, which does not have some of or the stated disadvantages.

The anodising agent should in particular be removable from an anodically oxidised surface so that the effort involved in cleaning the anodically oxidised surface of any remaining residues of the anodising agent is minimised as far as possible.

This and other problems are solved by an anodising agent according to the invention that is removable from the anodically oxidised surface, consisting of or containing

- an anodising compound consisting of or containing
  - an ion conducting medium containing an acid selected from the group consisting of phosphoric acid, sulphuric acid and organic carboxylic acids, in particular glycolic acid, lactic acid, oxalic acid, tartaric acid, citric acid and mixtures of said acids
  - one or a plurality of cohesion agents in a sufficient concentration in order to allow the substantially residue-free removal of the anodising agent from the anodically oxidised metal surface;

an electrically conductive planar structure in contact with the anodising compound as the cathode.

The anodising compound of the anodising agent according to the invention contains an ion conducting medium containing an acid selected from the group consisting of phosphoric acid, sulphuric acid and organic carboxylic acids, in particular glycolic acid, lactic acid, oxalic acid, tartaric acid, citric acid and mixtures of said acids, in order to allow ion conduction between anode and cathode during the anodic oxidation. If an organic carboxylic acid is used, this is preferably not a polymeric carboxylic acid. That is to say that the ion conducting medium provides ions as charge carriers (at least when a direct voltage is applied).

The anodising compound of the anodising agent according to the invention contains one or a plurality of cohesion agents in a sufficient concentration to allow the substantially residue-free removal of the anodising agent. The cohesion agent causes the anodising agent according to the invention to behave to a large extent as a mechanically coherent body. This means that when the anodising agent according to the invention is removed from the anodically oxidised surface there is no loss of cohesion within the anodising compound or between the anodising compound and the electrically conductive planar structure of the anodising agent acting as a cathode, but primarily a loss of cohesion between the anodically oxidised surface and the anodising compound. Therefore following removal of the anodising agent a surface is uncovered without any significant, in particular no visible, residues of the anodising compound.

In the context of this text, the term "removal" means breaking the adhesion between the anodising agent according to the invention and the anodically oxidised surface by application of a mechanical force, wherein the mechanical force preferably acts on the anodising agent in an area other than the adhesion zone (interface) between the anodising agent according to the invention and the anodically oxidised surface.

For practical reasons the anodising agent is preferably removable from the anodically oxidised surface in one piece and is thus not destroyed during removal. However, the present invention also relates to anodising agents whereby the removal from the anodically oxidised surface takes place in the form of a plurality of individual sections, on condition that following removal of the individual sections of the anodising agent the oxidised surface remains free of residues.

Apart from the ion conducting medium and one or a plurality of cohesion agents, the anodising compound can contain further components, in particular one or a plurality of humectants. These are described further on.

In order to secure the anodising agent according to the invention against unintentional slipping or falling away from the surface to be processed, it is preferable to set the adhesion of the anodising compound to the surface to be anodically oxidised sufficiently high, so that the anodising agent is self-adhering to the surface to be anodically oxidised. The adhesion of the anodising compound is adjusted in relation to its cohesion so that the anodising agent according to the invention as described at the outset is removable (peelable) from the anodically oxidised metal surface substantially without leaving a residue. The adhesion can for example be influenced in that as acids in the ion conducting medium and/or as cohesion agents and/or humectants one or a plurality of substances are used in each case which simultaneously have the effect of increasing adhesion. Here the proportion of substances with the effect of increasing adhesion depends on the composition and nature of the surface to be anodically oxidised, for which the anodising agent according to the invention is to be used.

Thus in a preferred embodiment of the anodising agent according to the invention the ion conducting medium contains lactic acid and optionally also one or a plurality of further acids such as for example phosphoric acid. Lactic acid has the effect of increasing adhesion.

In an embodiment of the anodising agent according to the invention the anodising compound comprises an external, that is to say an adhesion-promoting layer turned towards the surface to be anodically oxidised during the anodisation process, the composition of which is such that it has the desired adhesion to the surface to be anodically oxidised, and as an inner layer an anodising compound arranged between the outer adhesion-promoting layer and the electrically conductive planar structure. The composition of the latter is such that should it be brought into contact with the surface to be anodically oxidised, it would have a lower adhesion to this than the external adhesion-promoting layer. This can be achieved, for example, in that the external layer contains one or a plurality of acids and/or one or a plurality of cohesion agents and/or one or a plurality of humectants, which simultaneously have the effect of increasing adhesion, e.g. lactic acid, while the anodising compound does not contain such substances or only to a lesser extent. The transition between the two layers can be clear-cut or blurred. Here it is self-evident that both layers must be ion conductive. The adhesion and cohesion conditions here are set so that the adhesion-promoting layer can be removed together with the anodising compound without leaving a residue from the anodically oxidised surface.

The anodising agent according to the invention takes the form of a one-piece body comprising an anodising compound as defined above and an electrically conductive planar structure in contact with the anodising compound as the cathode. The anodising agent according to the invention is therefore not, as with the PANTA method, built up stepwise on the surface to be anodically oxidised by application of a gel-like ion conducting medium, fixing of the ion conducting medium by means of a porous body and arranging a conductive planar structure as a cathode on the ion conducting medium fixed in a porous body, but is arranged as a prefabricated cohesive solid body on the surface to be anodically oxidised. This prevents dispersal of the ion conducting medium and allows clean and rapid working.

The anodising agent according to the invention takes the form for example of a cohesive flat structure such as for example a foil or a film or of a coherent longitudinally extended structure, such as a tape. Flat structure means here bodies whose length and width have the same order of magnitude, whereas the thickness of the body is smaller by at least one, preferably two, orders of magnitude than the length and the width. Longitudinally extended structure on the other hand means bodies where the length is greater than the width by at least one, preferably two, orders of magnitude, whereas the thickness of the body is smaller by one, preferably by at least two, orders of magnitude than the width.

Whereas in order to remove conventional gel-like ion conducting media from a surface initially the excess gel is wiped away and then the remaining coating must be washed or rinsed away with intense cleaning effort, the anodising agent according to the invention can be removed as a cohesive body from the anodically oxidised surface, without any significant, in particular no visible, residues remaining on the anodically oxidised surface. Therefore in an advantageous manner the effort necessary when using conventional methods for local anodic oxidation for wet cleaning from the anodically oxidised surface of residues of the gel-like ion conducting medium is restricted. Accordingly the anodising agent according to the invention in particular allows the quantity of the cleaning fluids and in particular the rinsing water to be considerably reduced compared with conventional methods for local anodisation. Preferred embodiments of the anodising agent according to the invention can be removed from an anodically oxidised surface in such a way that rinsing to remove anodising agent residues is unnecessary.

In the context of this invention the anodically oxidised surface is preferably substantially free of residue, if following removal of the anodising agent the following criterion is met:

The dimension A of the surface of an object coming into contact with the anodising agent during anodic oxidation is measured. Once the anodising agent has been removed the mass $M_1$ of the object is determined. Then the anodically oxidised surface is rinsed with distilled water, until the surface covered with the anodising agent during the anodic oxidation is according to conventional standards free from any remaining residues. The object is dried and its mass $M_2$ is determined after drying. An anodising agent is removable without residue if the following condition is met:

$$\frac{M_1 - M_2}{A} \leq 1 \text{ g/m}^2,$$

preferably ≤0.5 g/m$^2$, particularly preferably ≤0.1 g/m$^2$.

For a density of the anodising compound of 1 g/cm$^3$ this corresponds to a layer thickness remaining on the surface following removal of the anodising agent of residue of on average 1 μm or less, preferably ≤0.5 μm or less, particularly preferably ≤0.1 μm or less.

The cohesion agent(s) contained in the anodising compound of the anodising agent according to the invention is (are) preferably water-soluble polymers.

"Water-soluble" means the characteristic of substances to form clear solutions in water. A condition is dissociable salt groups or a certain number of hydrophilic groups which are distributed evenly across the molecule.

"Water-soluble" polymers means natural or synthetic polymer whose common feature is their solubility in water or aqueous media. A condition of this is that these polymers have a sufficient number of hydrophilic groups for the water solubility and are not cross-linked. The hydrophilic groups can be non-ionic, anionic, cationic or zwitterionic, e.g.:

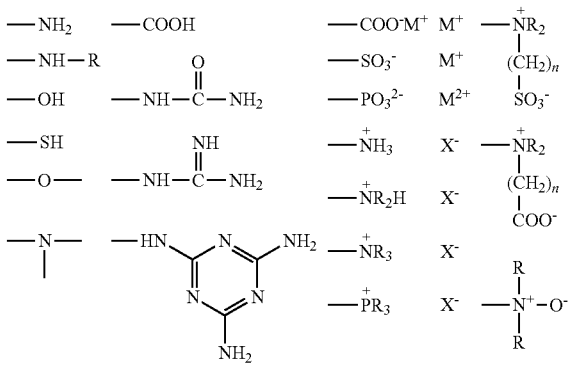

Preferably the water-soluble polymer(s) is (are) selected from the group consisting of polyvinyl alcohol; polysaccharides and their derivatives, in particular cellulose derivatives; partially hydrolysed polyvinyl esters; polyacrylates; polyacrylic acids; polyvinylpyrrolidone; polymethacrylates; polyamines and polyethers.

To increase the cohesion a person skilled in the art can on the one hand increase the concentration of the water-soluble polymer in the anodising compound and its molecular weight and/or add a further water-soluble polymer to the anodising compound.

Additionally or alternatively a person skilled in the art can also add thixotropic agents, such as for example fumed silica, bentonite, kaolin or calcium fluoride. The thixotropic agents also prevent undesired flowing or dripping of the anodising compound.

In the anodising agent according to the invention the mass ratio between the cohesion agent or all the cohesion agents contained and the acid or acids of the ion conducting medium is preferably 1:10 to 10:1.

In a preferred embodiment of the anodising agent according to the invention as the water-soluble polymer polyvinyl methyl ether (and optionally one or a plurality of additional water-soluble polymers) is used. Polyvinyl methyl ether has the effect of increasing adhesion.

The electrically conductive planar structure in contact with the anodising compound of the anodising agent according to the invention acts as a cathode during anodic oxidation. The material, from which the electrically conductive planar structure is formed, must be electrically conductive and resistant to the anodising compound. The electrically conductive planar structure is preferably an electron conductor.

The electrically conductive planar structure of the anodising agent according to the invention is preferably selected from among a metal weave, a metal film, a metal net, a metal grid, a perforated sheet, a textile fabric in carbon fibres, a conductive polymer film, a metalised plastic and a metalised plastic film. The metallisation of the plastic or of the plastic film can for example take place by evaporation or sputtering.

Preferably electrically conductive planar structures are used with a thickness of 0.05 to 2 mm.

The electrically conductive planar structure is preferably designed so that it is permeable to the hydrogen formed during the cathodic reaction of the anodic oxidation. Therefore electrically conductive planar structures in the form of wide-meshed nets, grids, woven fabrics or other textile fabrics are preferred. Where a film is used as an electrically conductive planar structure, this is preferably provided with holes, open areas and/or perforations therefore.

The thickness of the anodising compound arranged on the electrically conductive planar structure is preferably 0.05 mm to 2 cm, more preferably 0.05 mm to 2 mm, wherein any portions of the anodising compound that have penetrated the openings of the electrically conductive planar structure are not included in the calculation.

Within the anodising agent according to the invention the electrically conductive planar structure can also have a carrier effect for the anodising compound and thus contribute towards the mechanical stability of the anodising agent according to the invention.

Nevertheless, in order to improve the mechanical stability it can be useful to also provide in the anodising agent according to the invention a flat carrier which is in contact with the electrically conductive planar structure. This is an advantage in particular if as the electrically conductive planar structure a relatively open, for example wide-meshed, structure is used.

If the anodising agent according to the invention contains a carrier, then this is preferably arranged on the side of the anodising agent according to the invention which during the anodising process is turned away from the surface to be anodically oxidised.

The carrier is preferably selected from a weave, a fleece, a felt, a metal film and a polymer film. Preferably carriers are used with a thickness of 20 to 500 μm, particularly preferably 20 to 200 μm.

Preferred carriers are polymer films, particularly preferably polypropylene, polyethylene or polyethylene terephthalate films. Particularly preferred weave carriers are polyester- and/or cotton weaves. Also preferred as carriers, are fleeces and other carriers in the form of non-woven textile fabrics, in each case particularly preferably based on polyester. It is advantageous if the carrier is hydrogen-permeable but this is not absolutely necessary.

In a preferred embodiment of the anodising agent according to the invention the anodising compound further contains one or a plurality of humectants to keep the anodising compound moist. The humectant delays or prevents in an advantageous manner the complete drying out of the anodising compound. Particularly preferred humectants are hygroscopic substances such as for example glycerin, sorbitol and hygroscopic salts, for example magnesium chloride, aluminium chloride and calcium chloride.

The proportion of humectant(s) depends on their hygroscopicity and the hygroscopicity of the other components of the anodising agent, which are themselves hygroscopic. Acids contained in the ion conducting medium which for their part are hygroscopic are not classed among the further—that is to say additional to the already mentioned components in the form of an ion conductor and one or a plurality of cohesion agents—humectants within the meaning of the present invention which are contained in the anodising compound. The humectant is preferably used in such a quantity that after drying under standard conditions (3 days at 23° C. and 50% relative humidity under atmospheric pressure) the water content of the anodising compound is in the range 10 to 30 wt. % in relation to the dried anodising compound.

An anodising agent according to the invention can be produced in the following manner: the components of the anodising compound present in, for example, the form of aqueous solutions are blended to form a homogenous mixture and the mixture obtained in this way which is present in the form of an aqueous solution or paste is for example by means of a brush or by knife or spray application applied to a carrier (e.g. in polypropylene or polyethylene terephthalate film). Between the carrier and the mixture containing the components of the anodising compound an electrically conductive planar structure (for example a metal weave or a metal film) is embedded which serves as the cathode for the anodisation process.

For the production of such embodiments of the anodising agent according to the invention, which do not comprise a carrier, the mixture, containing the components of the anodising compound, can be applied directly to the electrically conductive planar structure forming the cathode. If the anodising compound is set to at a very low viscosity (not thixotropic) and/or the electrically conductive planar structure is very wide-meshed, the electrically conductive planar structure can be temporarily underlaid with a film or plate in a plastic with a low surface energy (such as PTFE), which is removed following drying.

The viscosity of the components of the mixture containing the anodising compound upon application to the carrier is greater than or equal to 10 mPas. The viscosity is preferably set so that it is optimally suited to the respective application method.

If the mixture which contains the components of the anodising compound is arranged on the surface of the carrier, the cohesion of the components of the anodising compound is increased automatically or through an external effect, in order to achieve the desired removal capability according to the invention of the anodising agent.

The cohesion of the anodising agent sought according to the invention is preferably achieved by a drying process, i.e. by evaporation of a solvent that is miscible with one of or all the components of the anodising compound, in particular water and/or an organic solvent. The anodising compound solidifies such that the anodising agent according to the invention can be removed from the anodically oxidised surface. The loss of solvent, e.g. water during drying is 10 to 80 wt. %, in particular 40 to 60 wt. %, frequently approximately 50 wt. %, of the solvent, e.g. water, contained in the starting mixture.

As an alternative to creating the cohesion by drying, the cohesion can be created by chemical cross-linking of components of the anodising compound. Thus, for example, polyvinyl alcohol and polyacrylic acid can be cross-linked with one another to form ester bonds, wherein a solidification of the anodising compound occurs. Cross-linking reactions are also possible if one or a plurality of cross-linking agents, e.g. monomeric acrylate or methacrylate, carrying a plurality of functional groups, are added to the anodising compound. Depending on the initiator system selected the cross-linking is started thermally or photochemically. Apart from the advantages already mentioned the anodising agent according to the invention is characterised by secure handling and high flexibility in use.

The ion conducting medium is bonded in the anodising compound of the anodising agent according to the invention. This can be disposed of after use. Products resulting from the anodisation (e.g. metal ions) likewise remain in the anodising compound.

The anodising agent according to the invention can also be used for anodic oxidation of the surface of a complex form object. A "complex form object" here means for example an object which is securely embedded in a larger structure, or an object with a curved surface, or an object requiring application of the anodising agent on a vertical surface or one pointing downwards.

The area of the anodising agent according to the invention can be cut to virtually any size. It is therefore suitable both for isolated processing of an area of just a few $cm^2$ and for the processing of larger area or linear-like structures, e.g. along an area that is intended for creation of a bond seam. Depending on the purpose of the application the length and width of the anodising agent according to the invention are in each case in the range 5 to 2000 mm, preferably 50 mm to 1000 mm. For anodising agents according to the invention in tape form in particular dimensions of up to 50 mm×2000 mm can be advantageous.

Owing to the self-adhesive characteristics, at least in the preferred embodiments, of the anodising agent according to the invention the additional retainers to secure the anodising agent required during conventional anodisation methods can be omitted.

The present invention also relates to the use of an anodising agent according to the invention for anodic oxidation of a metal surface. The metal surface preferably contains one or a plurality of metals selected from the group consisting of aluminium, titanium, zinc and magnesium and alloys of these or—particularly preferably—the metal surfaces consist of one of these materials.

The present invention further relates to a method for anodic oxidation of a metal surface comprising the following steps:

bringing an anodising agent according to the invention and the metal surface to be anodically oxidised into contact, so that the anodising compound of the anodising agent covers the metal surface to be anodically oxidised, and that the electrically conductive planar structure of the anodising agent does not touch the metal surface to be anodically oxidised;

connecting the metal surface to be anodically oxidised and the conductive planar structure of the anodising agent with a direct voltage source, so that the metal surface to be anodically oxidised is connected as an anode and the electrically conductive planar structure of the anodising agent as a cathode.

Between the surface to be anodically oxidised and the anodising compound of the anodising agent there must be no hollow spaces, since otherwise the anodisation of the surface would be incomplete. The anodising agent according to the invention, in preferred embodiments, because of the corresponding selection of suitable electrically conductive planar structures and—where present—carriers is flexible and therefore able to adapt to the structure of the surface to be anodised.

The direct voltage provided by the direct voltage source is preferably in the range 0.5 to 50 V, more preferably 6 to 20 V. The duration of the anodisation with the anodising agent according to the invention is preferably between one minute and two hours.

Once the anodic oxidation is sufficiently advanced that the desired surface quality has been achieved, i.e. an oxide layer with the desired quality and thickness has been formed, the anodising agent according to the invention can be removed from the anodically oxidised surface, without significant residues of the anodising compound remaining on the latter. Checking for the freedom from residues of the anodically oxidised surface takes place here as described above.

For subsequent cleaning all that is necessary is a short rinse with water or wiping with a damp cloth. The surface pretreated in this way can be used for producing high-quality, strong, adhesive bonds or coated finishes.

Typical applications of the anodising agent according to the invention or the method according to the invention are local pretreatment prior to bonding or coating of aluminium surfaces. Moreover, mechanical (chipping) reworking on an object often requires renewed anodic oxidation in order to protect the surface concerned.

Here the anodising agent according to the invention, owing to its ease of transportation and safe handling, can also be used for repair works "in-situ", that is to say at the site of an object that often can only be transported with great effort, on which the surface or partial areas of the surface are to be anodically oxidised.

EXEMPLARY EMBODIMENT

The invention is described in more detail in the following using the exemplary embodiment and the figures, without these restricting the scope of protection of the claims.

Figure 2A:
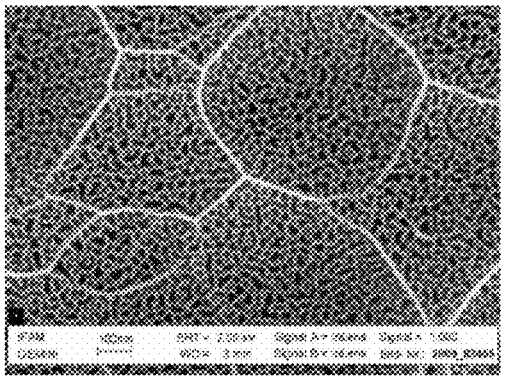
Figure 2B:
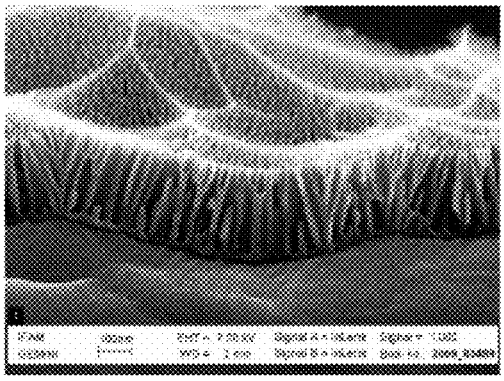

The figures show as follows:

FIG. 1 a schematic representation of a preferred embodiment of the anodising agent according to the invention and its use in a method according to the invention for anodic oxidation of a metal surface;

FIG. 2*a* a scanning electron microscope image of the surface of a test substrate in aluminium AA1050A oxidised using the anodising agent according to the invention from FIG. 1 (top view);

FIG. 2*b* a scanning electron microscope image of the surface of a test substrate in aluminium AA1050A oxidised using the anodising agent according to the invention from FIG. 1 (surface of a cryo-rupture).

The preferred embodiment shown schematically in FIG. 1 of the anodising agent according to the invention 1 comprises:

an anodising compound 2;

an electrically conductive planar structure 3 as the cathode;

a carrier 4.

Reference numeral 5 identifies the surface to be oxidised, and reference numeral 6 a direct voltage source.

For production of the anodising compound 2 the following solutions 48.8 g polyvinyl alcohol solution (Mowiol 10-98, Ter Hell, 20 wt. % in water);

9.9 g polyacrylic acid solution (AC7592, Alberdingk Boley, 47 wt. % in water);

9.8 g lactic acid (87% wt. % in water) and 48.4 g phosphoric acid (40 wt. % in water)

are homogenously mixed. The mixture obtained is applied in liquid form to an electrically conductive planar structure 3 in the form of a net in high-alloy steel (area 25 mm×25 mm, height 0.5 mm, mesh width 0.5 mm), which has first been placed on a carrier 4 in the form of a polyethylene terephthalate film with a thickness of 100 μm, and then allowed to dry. The weight loss occurring through drying is approximately 50 wt. %, in relation to the weight of the mixture applied to the net. Following drying (3 days at 23° C. and 50% relative humidity) the thickness of the anodising agent formed in this way is approximately 2 mm. The steel net 3 is approximately 1 mm below the surface of the anodising compound 2, that is to say that the thickness of the anodising compound protruding beyond the steel net is approximately 1 mm. The specific electrical volume conductivity of the anodising compound 2 is approximately 60 S/m. The anodising compound 2 is self-adhesive to the surface 5 to be anodically oxidised.

The anodising agent 1 according to the invention created in this way is bonded to the surface 5 to be anodically oxidised of an object, e.g. a test substrate of aluminium AA1050A, so that the anodising compound 2 of the anodising agent 1 covers the metal surface 5 to be anodically oxidised and the electrically conductive planar structure 3 of the anodising agent 1 does not touch the metal surface 5 to be anodically oxidised.

The metal surface 5 to be anodically oxidised of the test substrate of aluminium AA1050A and the steel net 3 of the anodising agent according to the invention are connected to a direct voltage source 6, wherein the metal surface 5 to be anodically oxidised is connected as an anode and the steel net 3 of the anodising agent 1 is connected as a cathode. For anodisation of the surface of the test substrate a direct voltage in the range 6 to 10 V is applied for 15 minutes.

Following anodisation the anodising agent according to the invention can be removed from the substrate without leaving residues. Scanning electron microscope images of the anodically oxidised surface of the test substrate show a layer of aluminium oxide with a porous structure typical of anodised layers (FIGS. 2*a* and 2*b*). The thickness of the aluminium layer is approximately 300 nm (FIG. 2*b*).

The invention claimed is:

1. A removable anodising agent for anodic oxidation of a metal surface comprising:

an anodising compound comprising:

an inner layer and an outer adhesion promoting layer oriented towards the metal surface, the outer adhesion promoting layer having a composition different from the inner layer;

an ion conducting medium containing an ion conducting component and an adhesion component, the adhesion component being in an amount selected for increasing adhesion of the anodizing agent to the metal surface prior to anodic oxidation; and one or a plurality of cohesion agents in sufficient concentration in order to allow a substantially residue-free removal of the anodising agent from the anodically oxidised metal surface; and an electrically conductive planar structure in contact with the anodising compound as the cathode;

wherein the adhesion component contains a lactic acid; and wherein the anodising compound has a proportion of the ion conducting medium to the one or the plurality of cohesion agents adjusted relative to a composition and a nature of the metal surface for removal of the anodising compound including the outer adhesion-promoting layer for the substantially residue-free removal of the anodising agent from the anodically oxidised metal surface.

2. Anodising agent according to claim 1, characterized in that the cohesion agent is a water-soluble polymer or the cohesion agents are water-soluble polymers.

3. Anodising agent according to claim 2, wherein the water-soluble polymer(s) is (are) selected from the group consisting of a polyvinyl alcohol; a polysaccharide; and a polysaccharide derivative.

4. Anodising agent according to claim 3, wherein the polysaccharide derivative is selected from the group consisting of a cellulose derivative, a partially hydrolysed polyvinyl ester, a polyacrylate, a polyacrylic acid, a polyvinylpyrrolidone, a polymethacrylate, a polyamine, and a polyether.

5. Anodising agent according to claim 1, characterized in that the electrically conductive planar structure is selected from among a metal weave, a metal film, a metal net, a metal grid, a perforated sheet, a textile fabric in carbon fibers, a conductive polymer film, a metalised plastic and a metalised plastic film.

6. Anodising agent according to claim 5, further comprising:

a carrier, which is in contact with the electrically conductive planar structure;

wherein the carrier is selected from a weave, a fleece, a felt, a metal film and a polymer film; and wherein the anodising compound further contains one or a plurality of humectants to keep the anodising compound moist.

7. Anodising agent according to claim 1, further comprising a carrier, which is in contact with the electrically conductive planar structure.

8. Anodising agent according to claim 7, characterized in that the carrier is selected from a weave, a fleece, a felt, a metal film and a polymer film.

9. Anodising agent according to claim 1, characterized in that the anodising compound further contains one or a plurality of humectants to keep the anodising compound moist.

10. Anodising agent according to claim 1, wherein the ion conducting medium further contains at least one of a phosphoric acid, a sulfuric acid, a glycolic acid, an oxalic acid, a tartaric acid, and a citric acid.

11. Anodising agent according to claim 1 wherein anodising compound has the proportion of the ion conducting medium to the one or the plurality of cohesion agents adjusted relative to the composition and the nature of the metal surface for self-adhesion of the anodizing agent to the metal surface prior to and during anodic oxidation of the metal surface.

12. An anodising system comprising:

a metal surface; and an anodising agent disposed on the metal surface;

wherein the anodising agent comprises an anodising compound and an electrically conductive planar structure, the anodising compound being disposed between the metal surface and the electrically conductive planar structure, the anodising compound being in contact with the electrically conductive planar structure, and the electrically conductive planar surface being disposed separate from the metal surface;

wherein the anodising compound comprises:

an ion conducting medium containing an ion conducting component and an adhesion component, the adhesion component being in an amount selected for adhesion of the anodising agent to the metal surface; and one or a plurality of cohesion agents in sufficient concentration for substantially residue-free removal of the anodising agent from the metal surface following anodic oxidation of the metal surface;

wherein the adhesion component is a lactic acid; and wherein the anodising compound comprises an inner layer and an outer adhesion promoting layer oriented towards the metal surface, the outer adhesion layer having a composition different from the inner layer.

13. The anodising system of claim 12, wherein following removal of the anodizing agent from the metal surface, a thickness of a layer of the anodising compound remaining on the metal surface is an average amount of $\leq 1$ μm.

14. The anodising system of claim 12, wherein the anodising compound has a proportion of the ion conducting medium to the one or the plurality of cohesion agents adjusted relative to a composition and a nature of the metal surface for removal of the anodising compound including the outer adhesion-promoting layer for a substantially residue-free removal of the anodising agent from the anodically oxidised metal surface.

* * * * *